US012668936B2

(12) United States Patent
Schwager et al.

(10) Patent No.: US 12,668,936 B2
(45) Date of Patent: Jun. 30, 2026

(54) TYPE III TRAFFIC BARRICADE

(71) Applicant: Remcon Plastics Incorporated, Reading, PA (US)

(72) Inventors: Benjamin R. Schwager, Boyertown, PA (US); James P. Connors, Villanova, PA (US); Peter J. Connors, Radnor, PA (US)

(73) Assignee: Remcon Plastics Incorporated, Reading, PA (US)

( * ) Notice: Subject to any disclaimer, the term of this patent is extended or adjusted under 35 U.S.C. 154(b) by 380 days.

(21) Appl. No.: 18/442,695

(22) Filed: Feb. 15, 2024

(65) Prior Publication Data

US 2025/0179744 A1 Jun. 5, 2025

Related U.S. Application Data

(60) Provisional application No. 63/604,577, filed on Nov. 30, 2023.

(51) Int. Cl.
*E01F 9/692* (2016.01)
*E01F 9/70* (2016.01)

(52) U.S. Cl.
CPC ..... *E01F 9/692* (2016.02); *E01F 9/70* (2016.02)

(58) Field of Classification Search
CPC ... E01F 13/02; E01F 9/692; E01F 9/70; E01F 13/022
See application file for complete search history.

(56) References Cited

U.S. PATENT DOCUMENTS

| | | | | |
|---|---|---|---|---|
| 4,071,224 | A | 1/1978 | Gilbert | |
| 4,183,695 | A * | 1/1980 | Wilcox | E01F 9/635 482/16 |
| 4,312,600 | A | 1/1982 | Schaaf et al. | |
| 4,674,432 | A | 6/1987 | Schmanski | |
| 4,792,258 | A | 12/1988 | Goff | |
| 4,859,983 | A | 8/1989 | Kulp et al. | |
| 5,860,386 | A | 1/1999 | Schwab et al. | |
| 6,616,368 | B2 | 9/2003 | Birchler et al. | |

(Continued)

FOREIGN PATENT DOCUMENTS

| | | | | |
|---|---|---|---|---|
| CH | 708355 | A2 * | 1/2015 | F16M 11/18 |
| GB | 2323113 | A | 9/1998 | |

(Continued)

OTHER PUBLICATIONS

Remcon Safety Products, Type 3 Breakaway Barricade General Specifications, Mar. 8, 2024.

*Primary Examiner* — Theodore N Yao

(57) ABSTRACT

A rotationally molded type III traffic barricade system has a plurality of bases and uprights adapted to be assembled in a shipping configuration, a transportation configuration and a deployment configuration. Each upright has recess for receiving a warning light and a cushion adjacent the recess for absorbing the impact force of a collision between the barrier and a vehicle. Recesses are also provided in the upright for receiving barricade panels in such a manner that the chance of damage to the panels is minimized during transportation, etc. Dimples in the recesses and opposing cones on the rear surface of the upright guide an assembler as to where to drill holes for bolts that mount the barricade panels to the uprights.

20 Claims, 14 Drawing Sheets

(56) References Cited

U.S. PATENT DOCUMENTS

| | | | | |
|---|---|---|---|---|
| 6,676,113 | B2 | 1/2004 | Christensen et al. | |
| 7,111,815 | B2 | 9/2006 | Mettler et al. | |
| 7,523,715 | B2 | 4/2009 | Mettler et al. | |
| 8,807,864 | B2 | 8/2014 | Kulkarni et al. | |
| 9,297,127 | B2 | 3/2016 | Mettler et al. | |
| 9,771,736 | B1 | 9/2017 | Levran | |
| 9,822,502 | B2 | 11/2017 | James | |
| 10,683,624 | B2 | 6/2020 | Whiteley | |
| 10,941,530 | B2 | 3/2021 | Calby | |
| 11,028,545 | B2 | 6/2021 | Powell | |
| 11,427,977 | B2 | 8/2022 | Owen et al. | |
| 2002/0136603 | A1* | 9/2002 | Birchler | E01F 9/627 404/9 |
| 2007/0241255 | A1* | 10/2007 | Dvoracek | G09F 15/0056 248/346.01 |
| 2008/0213041 | A1* | 9/2008 | Lipniarski | E01F 13/02 404/6 |
| 2009/0196689 | A1 | 8/2009 | Pellegrino | |
| 2014/0270937 | A1 | 9/2014 | Kulkarni et al. | |
| 2019/0301114 | A1 | 10/2019 | Chamberland | |

FOREIGN PATENT DOCUMENTS

| | | | |
|---|---|---|---|
| GB | 2605634 | A | 10/2022 |
| WO | 2022/216163 | A | 10/2022 |

* cited by examiner

TYPE III TRAFFIC BARRICADE

CROSS REFERENCE TO RELATED APPLICATIONS

This application claims the benefit of, and claims priority to, commonly assigned U.S. Provisional Patent Application No. 63/604,577 filed Nov. 30, 2023 entitled "Type III Traffic Barrier", the disclosure of which is incorporated herein by reference in its entirety.

TECHNICAL FIELD

The disclosure of this application relates to so-called type III traffic barricades.

BACKGROUND

A type III traffic barricade is typically used to alert motorists of a detour, a closed traffic lane, a hazard, etc. and to prevent them from traveling along the closed lane, in the area of the hazard, etc. A type III barricade consists of three highly visible, marked horizontal panels or boards (usually with an orange and white striped pattern) mounted to an upright frame. Since the barricades undergo frequent transportation from one site to another, they should be capable of easy and secure transportation, quick and easy disassembly and reassembly by road work crews, and compact storage. In addition, since the barricades are usually sold to the end user (typically a state or local traffic agency, a highway or road construction or maintenance entity, etc.), they should be capable of being securely and compactly packaged in bulk form for shipment in a disassembled form from the seller to the end user.

When deployed, type III barricades also frequently have a pair of flashing warning lights affixed to a top end thereof. In the event of a collision between a vehicle and a barricade, it is possible for the flashing light to become dislodged from the barrier and crash into the vehicle and cause damage to the vehicle body and/or windshield. It is desirable that the barricade be manufactured in a manner that minimizes this possibility.

SUMMARY

There is disclosed a traffic barricade system wherein each barricade comprises a thermoplastic upright having a pair of opposing, substantially parallel legs and a connecting panel substantially perpendicularly joining the legs, so as to define a generally U-shaped upright. Each leg has an aperture adjacent a bottom end thereof ("leg apertures") and at least a pair of recessed portions adapted to receive a barricade panel that serves as a warning. The connecting portion also has a recessed portion for receiving a barricade panel, such that, when assembled, the barricade has three generally horizontal barricade panels.

Each leg has an opening into the interior thereof at its bottom ("post receiving aperture") for interacting with posts on a base portion of the barricade. A pair of recessed portions on the back surface of the connecting panel is adapted to receive a pair of warning lights ("warning light recesses"). A hollow space between the warning light recesses and an adjacent front portion of the upright provides a cushion that deforms the corresponding area of the barricade in the event of a collision between a vehicle and the barricade and absorbs the shock of the collision. The cushion thus serves to decelerate the battery compartment of the light (the heaviest component) in the event of a collision and minimizes the force of impact upon the vehicle from the battery compartment of the warning light. This feature minimizes the chance that the battery compartment will penetrate the cabin of the vehicle and therefore addresses the greatest threat to the windshield/passenger compartment. The cushion may spring back to its original shape after the collision.

The base of each barricade comprises a thermoplastic substantially rectangular base that is substantially equal in width to the width of the uprights. Side members of the base each have the aforementioned post extending from the top surface thereof. A protrusion extends from the top surface of each post and defines a pin. There is a recess in the bottom surface of each base opposite each pin ("base recesses") and an aperture in the opposite end of each base ("base apertures").

The features of uprights and bases allows for a variety of configurations, i.e., for shipping from the manufacturer or distributor to the end user, for deployment at the site of a hazard or detour, and for transporting the barricades from one site to another.

In a shipping configuration, the bases are stacked on a pallet such that alternating bases are oriented in a reverse direction relative to one another, the posts of the bases are received into the base apertures of adjacent bases in the stack, and the pins are received into the base recesses of alternating bases. In this manner, the bases interlock with one another and form a cavity. The uprights are inserted into the cavity, such that the pallet with the assembled uprights and bases may be lifted onto truck for transport to the end user. The barricade panels, warning lights, and assembly hardware may be separately packaged for shipment.

In a deployment configuration, uprights are assembled to bases by lifting each upright over a base and lowering it such that the posts are received into the post receiving apertures and thus each upright becomes perpendicularly (and removably) attached to the base.

In a transportation configuration, the uprights are disassembled from the bases and are stacked in an interleaved form, preferably with each in a vertical position, such that the uprights are sandwiched between bases to define a deck. In this configuration, the posts are received into the leg recesses of adjacent uprights and the pins are received into the base recesses of a next base in the deck.

It will be appreciated that the interlocking of the bases and uprights in the shipping and transportation configurations provides for secure stacking, and that the cooperation of the posts and post receiving recesses allows for quick and easy assembly and disassembly.

In a preferred embodiment, the uprights and bases are manufactured using a rotational mold, and substantial portions of the interior thereof are hollow.

DETAILED DESCRIPTION OF THE DRAWINGS

DETAILED DESCRIPTION OF ILLUSTRATIVE EMBODIMENTS

Figure 1:
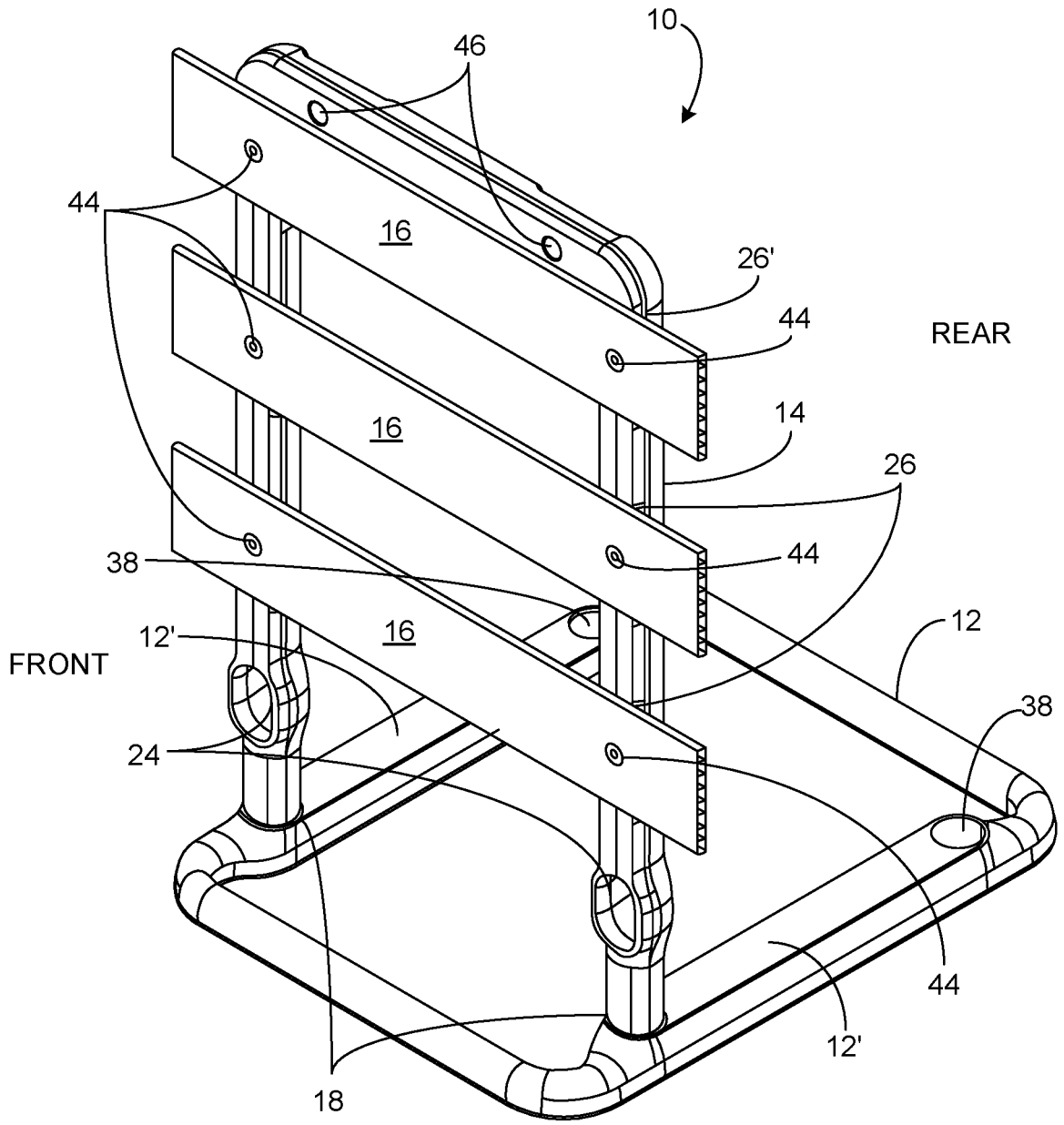
FIG. 1 is a perspective view of an assembled barricade and illustrates the deployment configuration.

Referring to the drawings, wherein like numerals represent like elements, there is illustrated in FIG. 1 an exemplary barricade 10 according to one embodiment. Barricade 10 comprises a base 12, an upright 14 and a plurality of barricade panels 16 affixed to the upright 14 via bolts 44. As is known, the front facing surfaces of barricade panels 16 are usually marked with orange and white stripes, typically with a highly reflective tape, so as to be highly visible to motorists.

Figure 2:
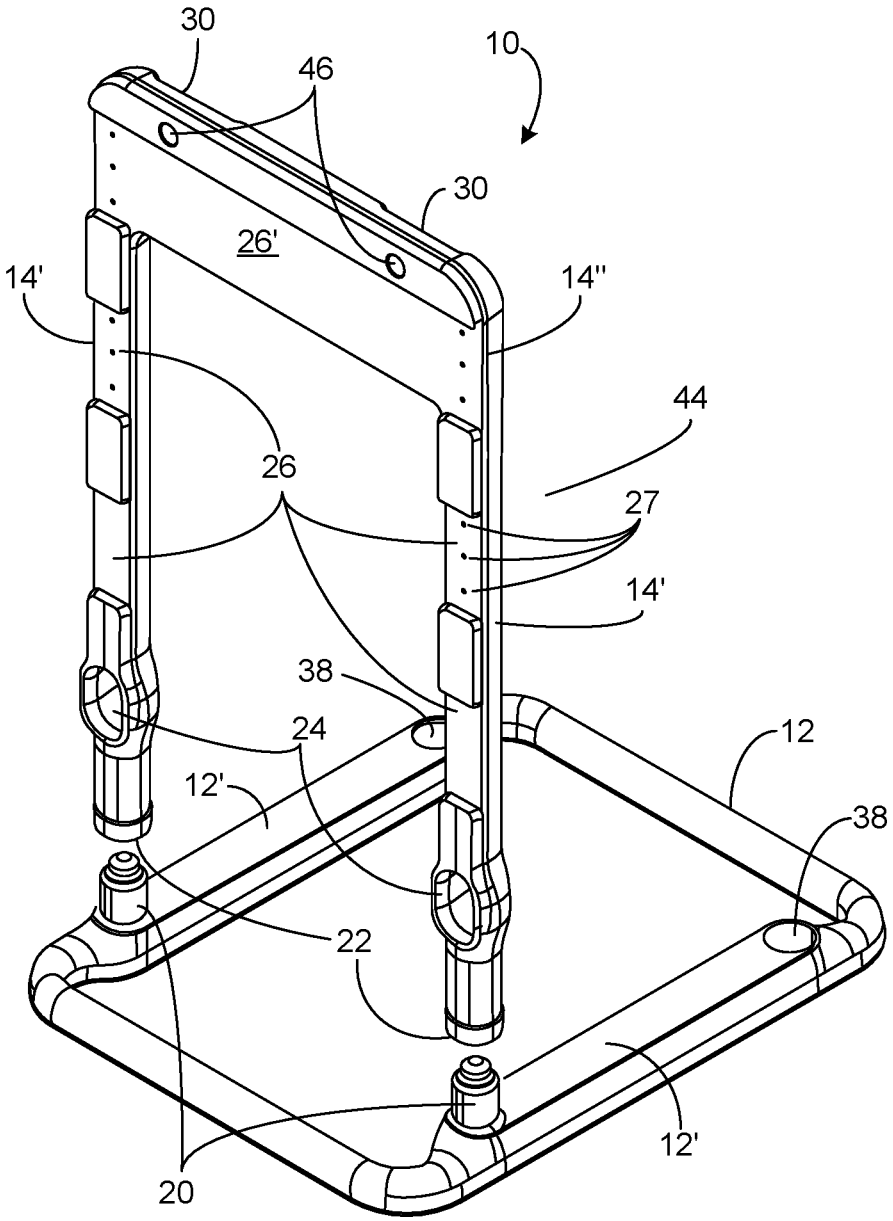
FIG. 2 illustrates the cooperation between an upright and a base.

As shown in FIGS. 1 and 2, the base is substantially rectangular in shape and comprises integral posts 20 at one end of the side members 12' thereof and apertures 38 through the top to the bottom surface of the side members at the opposite ends ("base apertures"). The base is preferably a single, unitary piece of substantially hollow thermoplastic material formed in a rotational mold. As shown, the side members 12' may have extended wide portions to provide stability.

As also shown in FIGS. 1 and 2, the upright is substantially U-shaped such that the bottom part of the U defines a substantially horizontal top portion of the upright. Thus, the upright is defined by vertical legs 14' and an integral substantially perpendicular connecting panel 14". Preferably, the upright is a single, unitary piece of substantially hollow thermoplastic material formed in a rotational mold. The upright comprises recessed portions 26 in the legs 14' and a recessed portion 26' in the connecting panel 14" each adapted to receive a barricade panel 16. The barricade panels may be affixed to the uprights via bolts 44. Holes 46 may be provided at the top of the connecting panel to allow warning lights to be affixed to the upright, as described in more detail below. Openings 24 are provided through the front to the back surface of the legs ("leg apertures") at ends opposite those joined to the connecting panel. Openings 22 in the bottom of each leg open into the hollow interior thereof, in a direction substantially perpendicular to the direction of the openings 24 and are adapted to receive the posts 20 when assembled in the deployment configuration ("post receiving apertures"). Recesses 30 on the back side of the upright adjacent the connecting panel are adapted to receive the warning lights.

Figure 5:
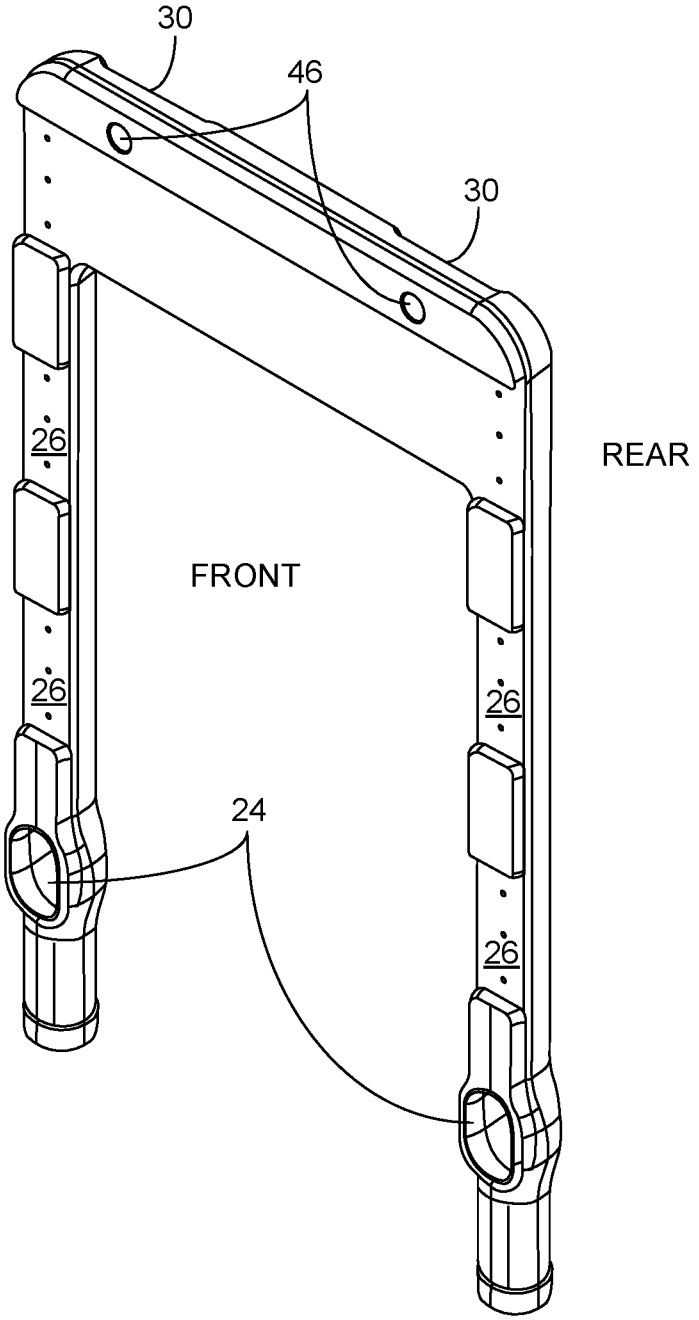
FIG. 5 illustrates further details of the upright.
Figure 7:
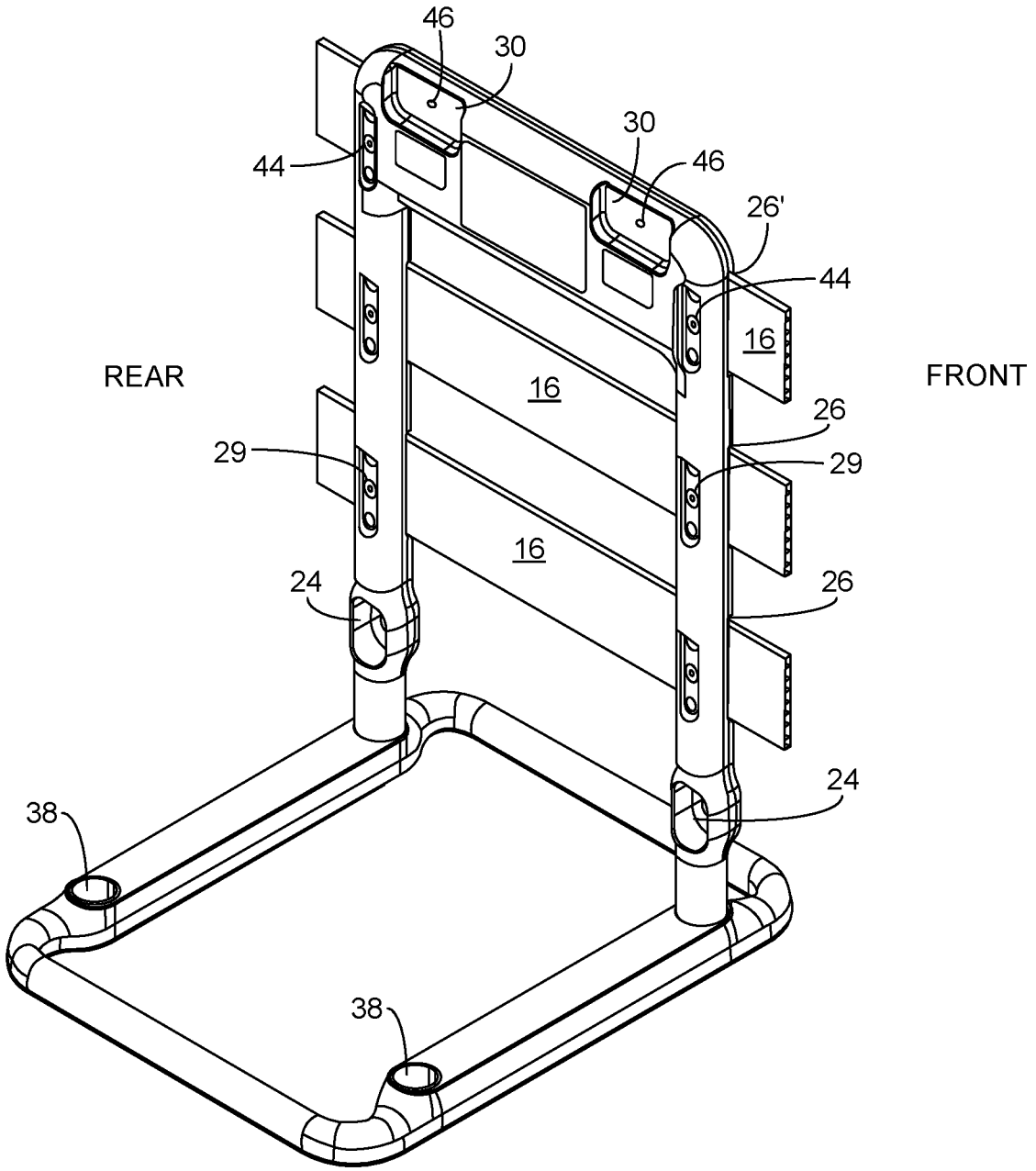
FIG. 7 illustrates further details of a barricade, the warning light recesses and the manner in which barricade panels are affixed to the uprights.

It will be appreciated, for example, from FIG. 5, that the depth of the recesses 26 and recessed portions 26' is such that, once installed, front surfaces of panels 16 sit slightly below the front surface of the upright, thus minimizing the opportunity for scratching and marring of the panels when the barricades are stacked or decked, and also in the event that a barricade is struck by a vehicle and the upright is propelled face down onto the roadway. Thus, the recesses provide a number of benefits including: (i) they remove the guesswork out of how to vertically space the panels on the uprights; (ii) they allow for consolidated stacking of bases and uprights when the boards are assembled; and (iii) they minimize the opportunity for damage to the reflective tape on the panels (the tape is the most expensive part of the panel). As best shown in FIGS. 2 and 7, inwardly facing dimples 27 are provided on the front surface of each of the barricade panel recesses 26 and 26' (FIG. 2) and inwardly facing cones 29 are provided on the back surface of the upright opposite each dimple 27. The dimples and cones are adapted to receive a drill bit for drilling holes through the recesses 26, 26" and thus provide guidance to an assembler as to where drill the holes for receiving bolts 44.

Figure 3A:
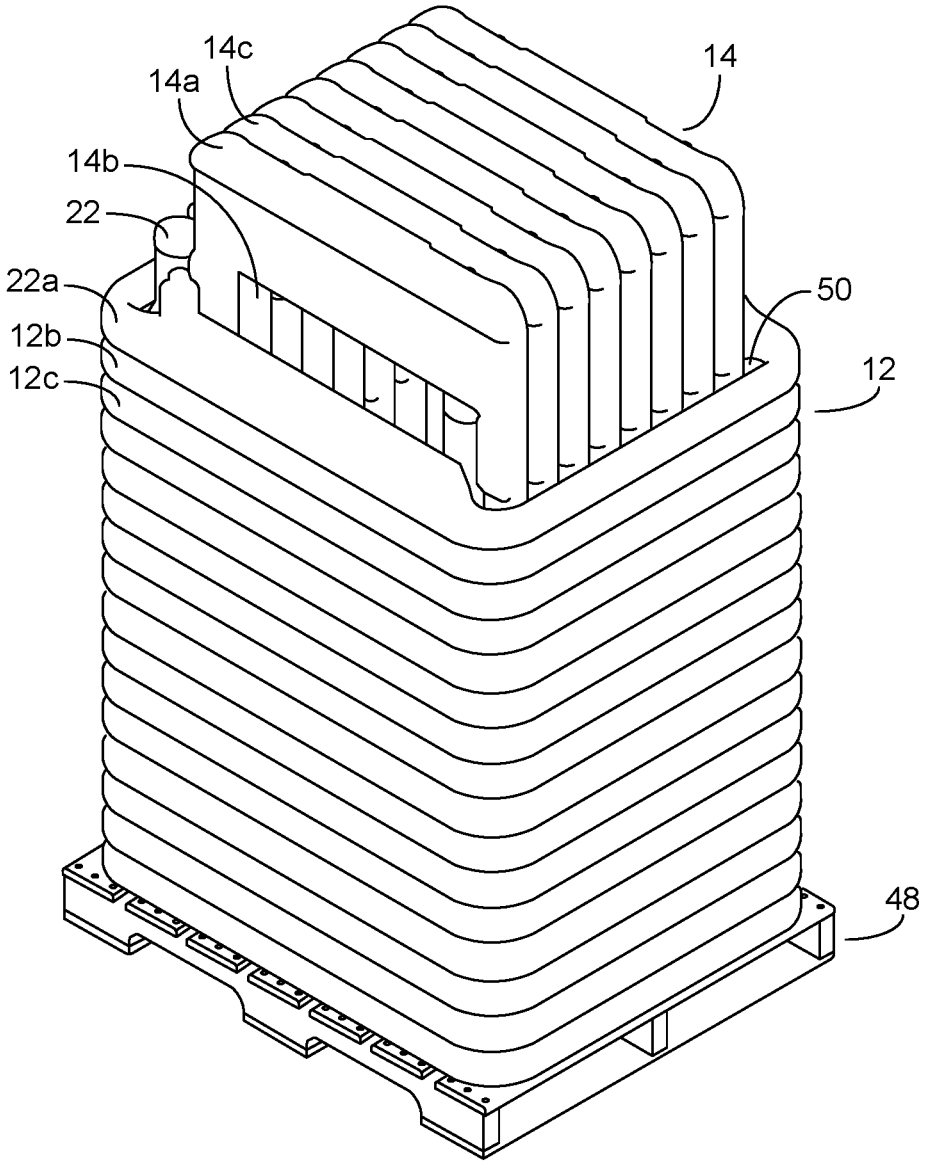
FIGS. 3A-3D illustrate details of the shipping configuration.
Figure 3B:
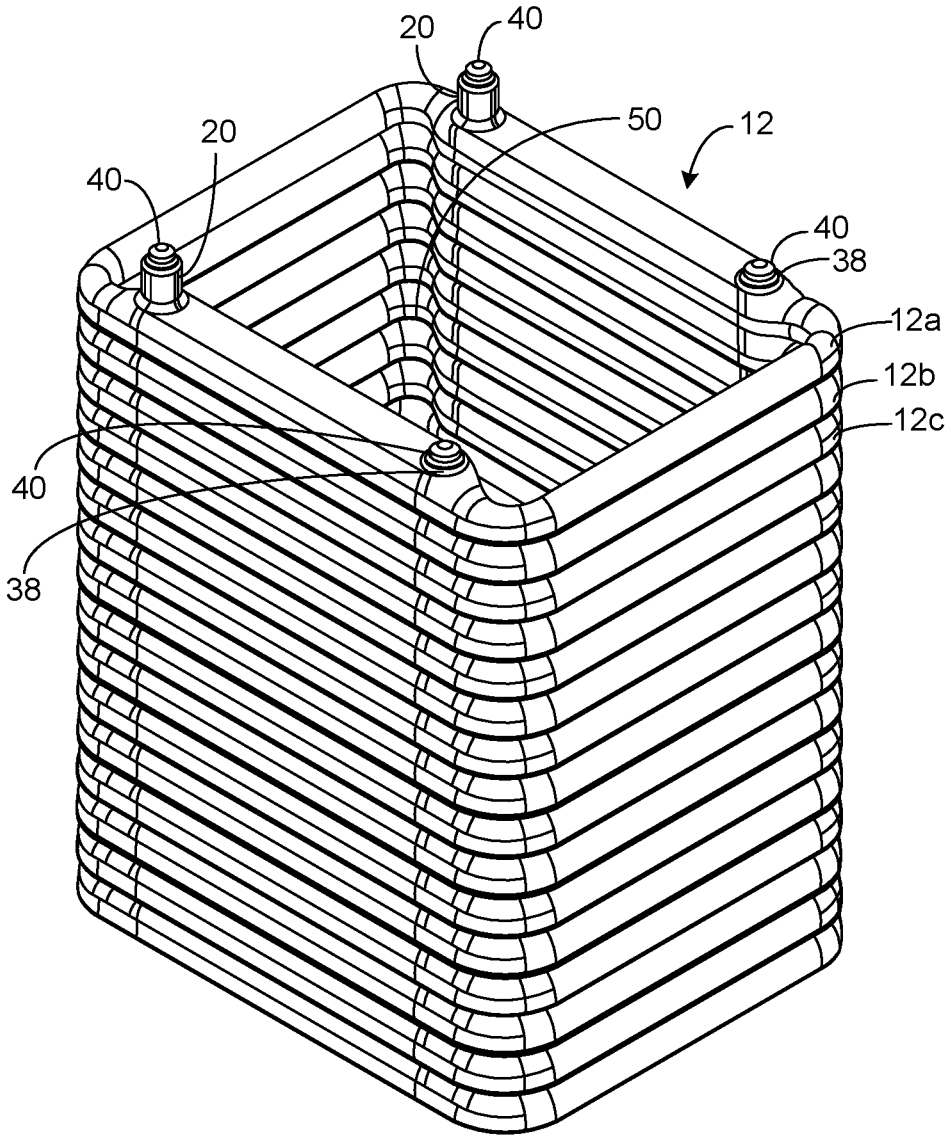
Figure 3C:
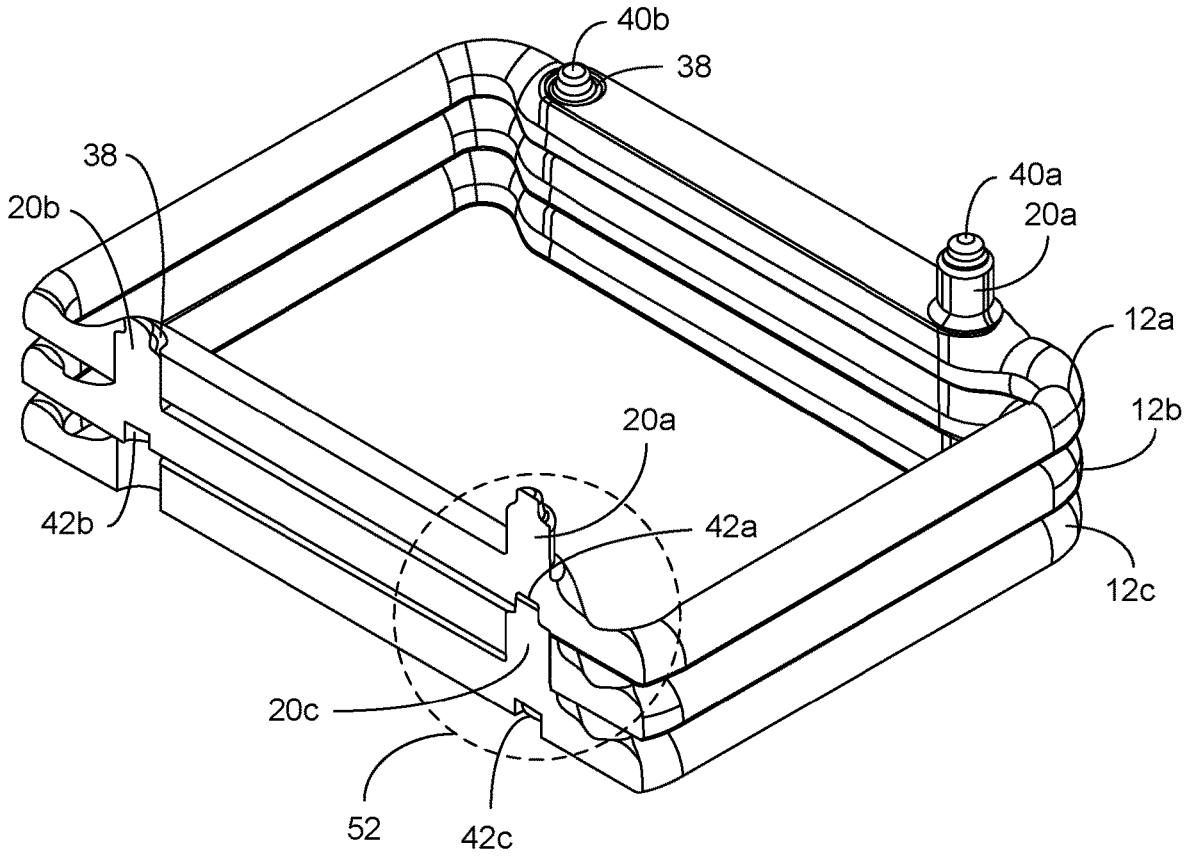
Figure 3D:
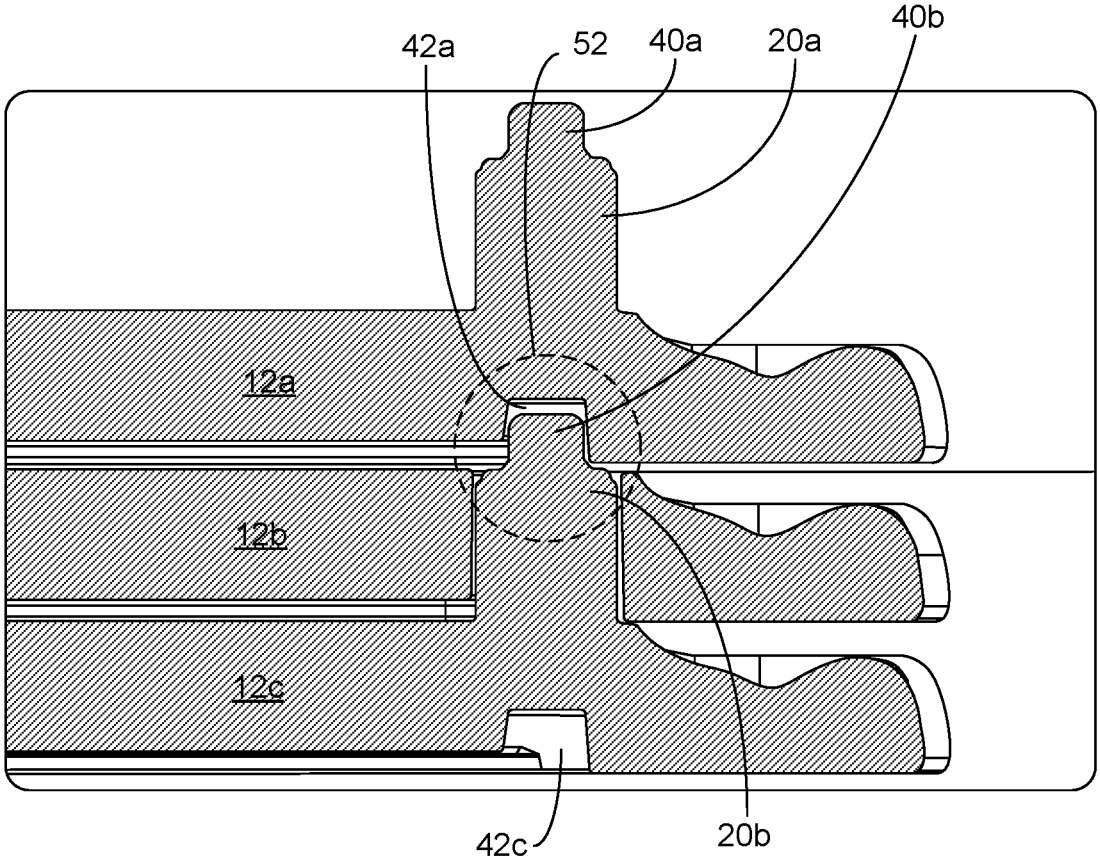

FIGS. 3A-3D illustrate the shipping configuration and the details of the uprights and bases that allow them to be securely stacked for shipment. As shown in FIG. 3A, a plurality of bases 12 may be stacked on a pallet 48. The stacked bases define a cavity 50 into which a plurality of uprights 14 may be inserted. FIGS. 3B, 3C and 3D illustrate the manner in which the posts 20, base apertures 38, bases recesses 42 and protrusions 40 cooperate. As shown, each base 12 is oriented in a reverse direction relative to an adjacent base in the stack. Thus, base 12*a* is oriented 180 degrees relative to base 12*b*, and base 12*c* is oriented 180 degrees relative to base 12*b* and is oriented in the same direction as base 12*a*. In this manner, and as best shown in FIGS. 3C and 3D, the posts 20 are received into the base apertures 38 of adjacent bases in the stack and the protrusions 40 are received into the base recesses 42 of alternating bases such that the bases interlock with one another. Particularly, in this configuration, the posts 20*b* of bases 12*b* are received into base apertures 38 of base 12*a*, the protrusions on the top of post 20*c* of base 12*c* are received into the base recesses 42*a* of base 12*a*, and so on. The detail encircled by circle 52 (FIG. 3C) is illustrated in FIG. 3D and better illustrates the interlocking features of the bases when stacked for shipment. Thus, the bases may be securely stacked to prevent shifting, damage, etc. during shipment. As shown in FIG. 3A, each upright may be vertically oriented 180 degrees relative adjacent to each other when placed in the cavity 50 for compact and secure storage during shipment. Thus, as shown, upright 14*a* may be vertically oriented 180 degrees relative to upright 14*b*, and upright 14*c* may be vertically oriented 180 degrees relative to upright 14*d* and in the same orientation as upright 14*a*.

Figure 4A:
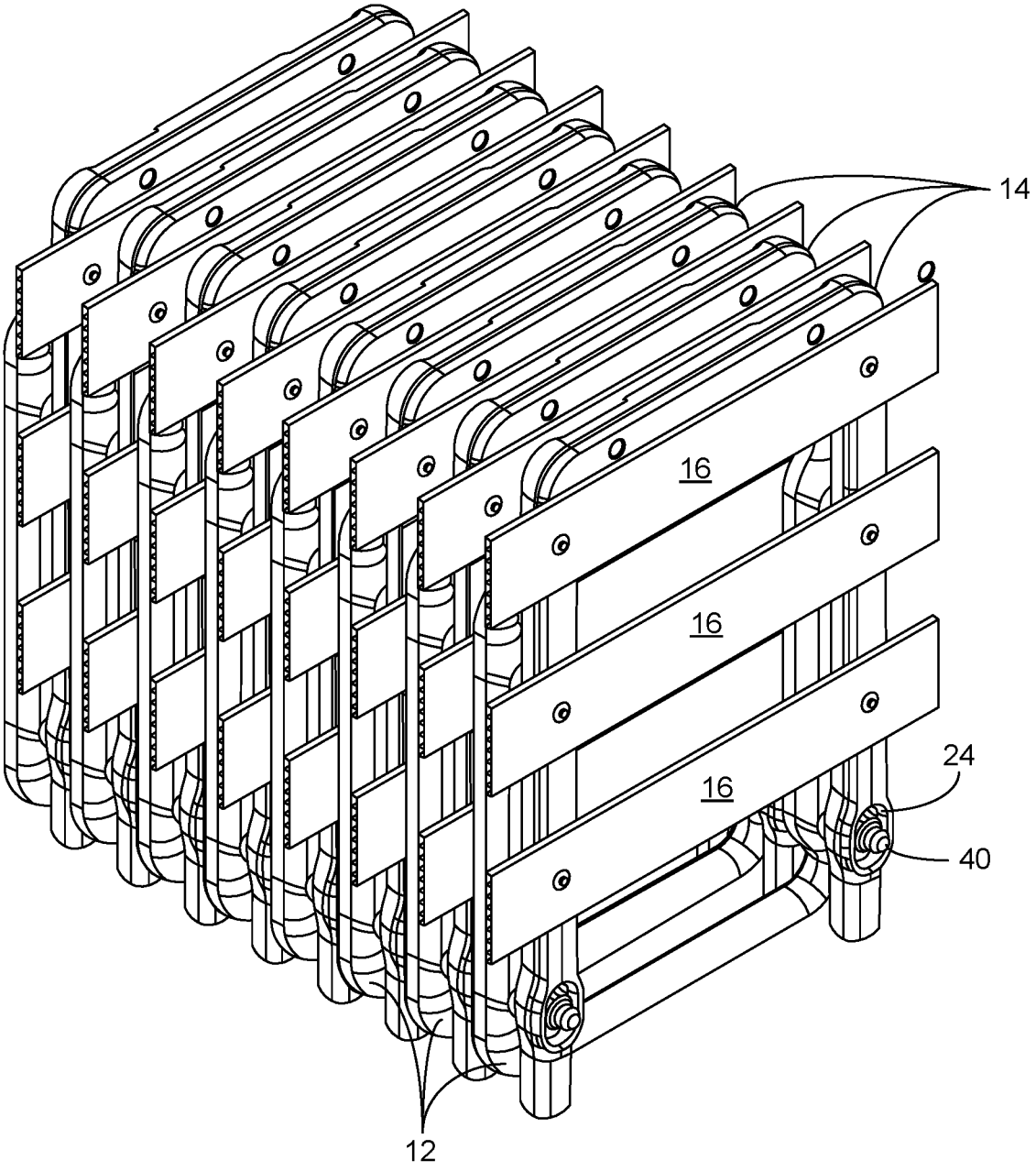
FIGS. 4A-4D illustrate details of the transportation configuration.
Figure 4B:
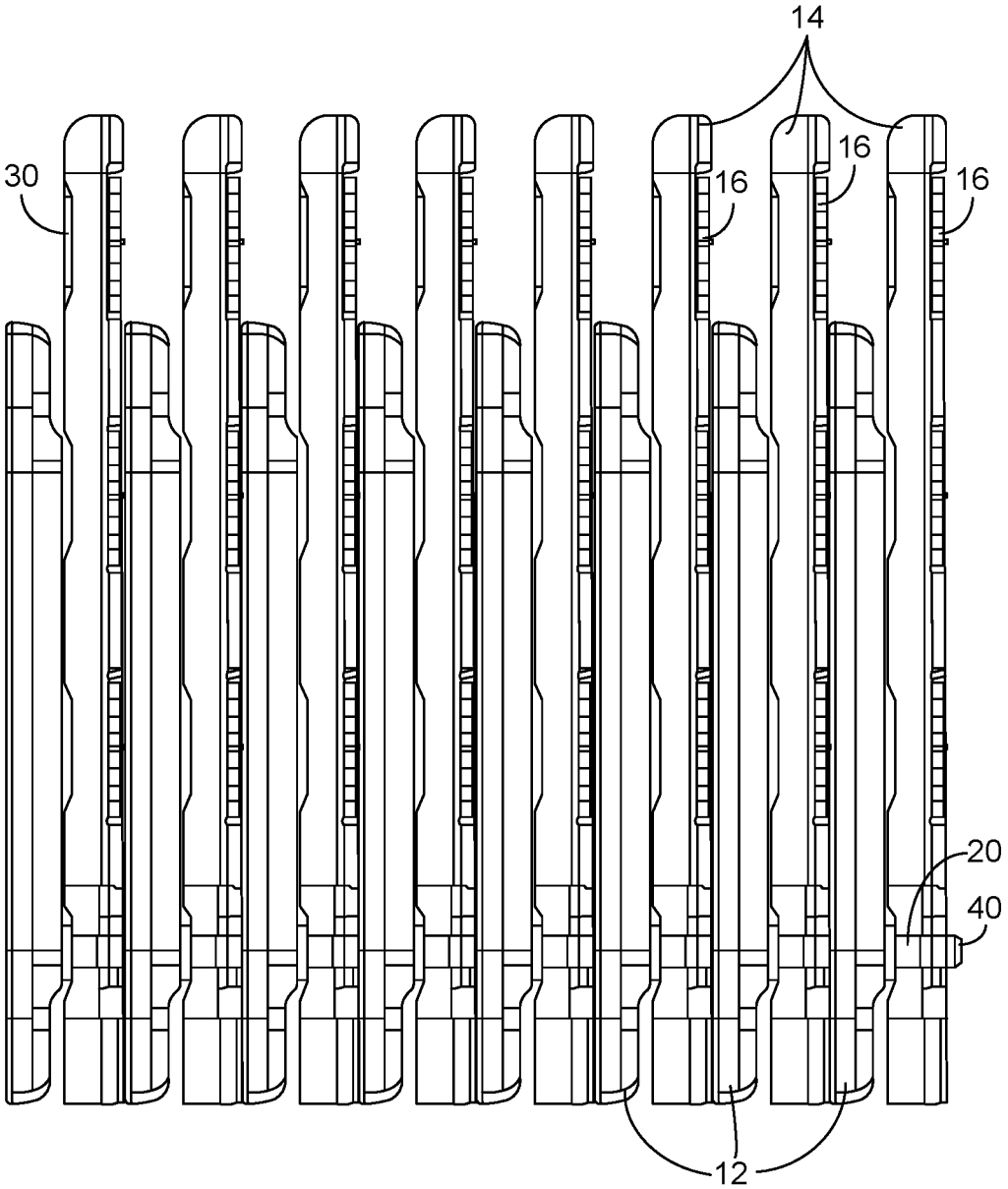
Figure 4C:
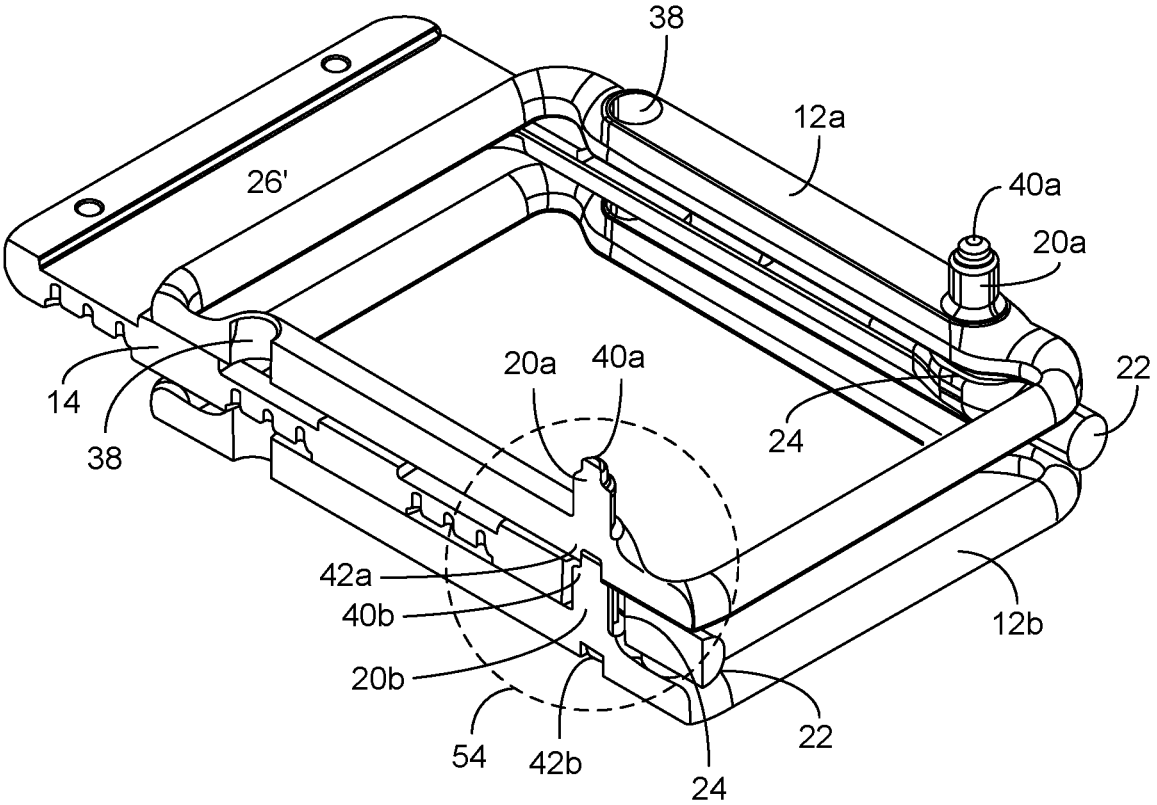
Figure 4D:
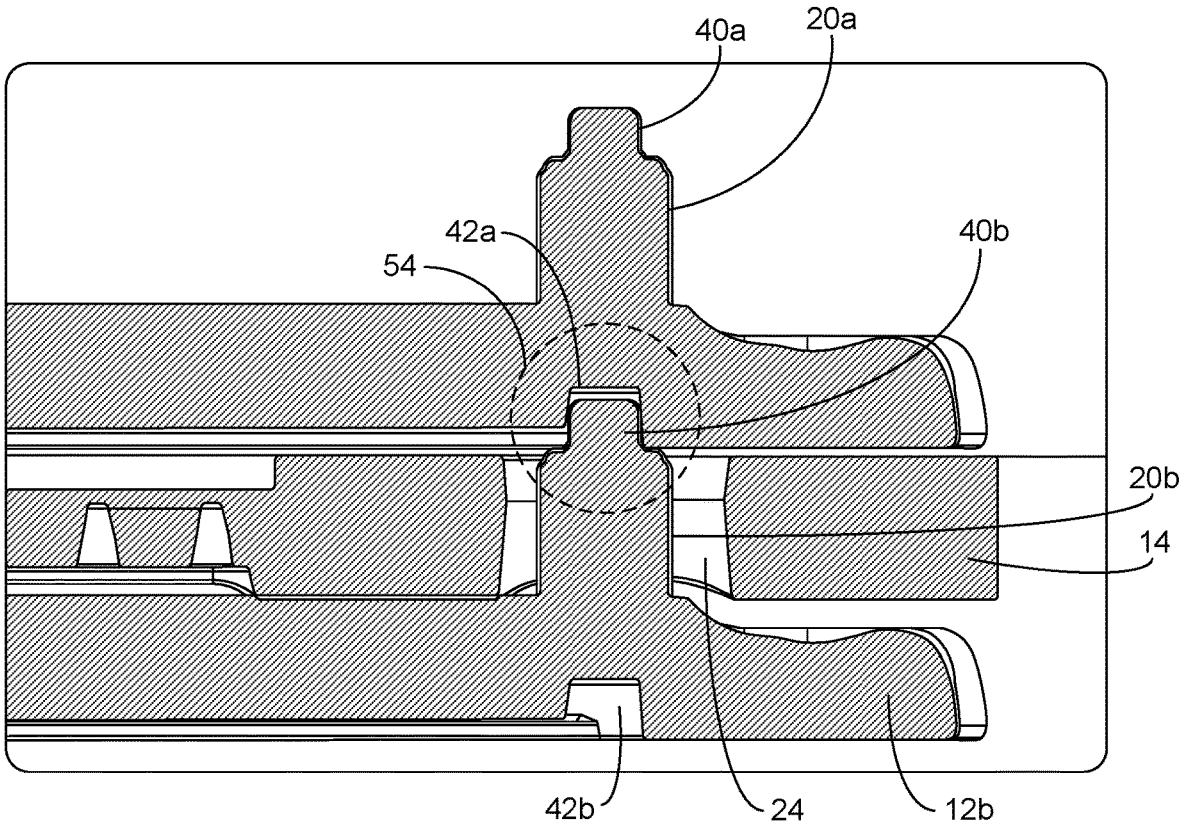

FIGS. 4A-4D illustrate the transportation configuration and the details of the uprights and bases that allow them to be securely stacked for transportation between sites, from a storage depot or the like to a site, or from a site to a storage depot. This configuration is usually employed following disassembly of an assembled barricade (i.e., FIG. 1) described below. As shown in FIGS. 4A and 4B, a plurality of bases 12 and uprights 14 may be interleaved such that the uprights are sandwiched between bases to form a deck of bases and uprights. In this configuration, the uprights are oriented in the same direction relative to one another, the bases are oriented in the same direction relative to one another. Thus, the bases and uprights are oriented such that each post 20 of a base is received into the post receiving aperture 24 of an adjacent upright, and further such that each protrusion 40 on a post 20 is received into the base recess 42 of a next base in the deck. FIGS. 4C and 4D provide further detail. As shown, adjacent bases 12*a* and 12*b* are separated by an interleaved upright 14. Posts 20*b* of base 12*b* are received into the post receiving apertures 24 of upright 14 and protrusions 40*b* on post 20*b* are received into the base recesses 42*a* of base 12*a*. The posts 20*a* and protrusions 40*a* of base 12*a* are received the post receiving apertures and base recesses of a next pair of uprights and bases (i.e., those above base 12*a* in FIG. 4C), and base recesses 42*b* of base 12*b* receive the protrusion of a base that, in reference to FIG. 4C, is below base 12*b*. Again, due to the interlocking feature of the posts and post receiving apertures, and the protrusions and base recess, the deck of interleaved uprights and bases is compact, and is secure and prevented from shifting during transport. The detail encircled by circle 54 is illustrated in FIG. 4D and better illustrates the interlocking arrangement of the uprights and bases in the transportation configuration.

FIGS. 1, 2, and 7 illustrate the deployment configuration (note that the warning lights are not illustrated in these Figs. and that panels 16 are not shown in FIG. 2). It will be appreciated that deployment merely requires that an upright be placed over a base and then lowered such that posts 20 on the base are received into the post receiving apertures 22 of the upright. A friction fit between the interior surface of the post receiving aperture and the exterior surface of the post ensures that the upright is easily and securely fastened to the base yet is easily removable by pulling the upright from the base.

Figure 6:
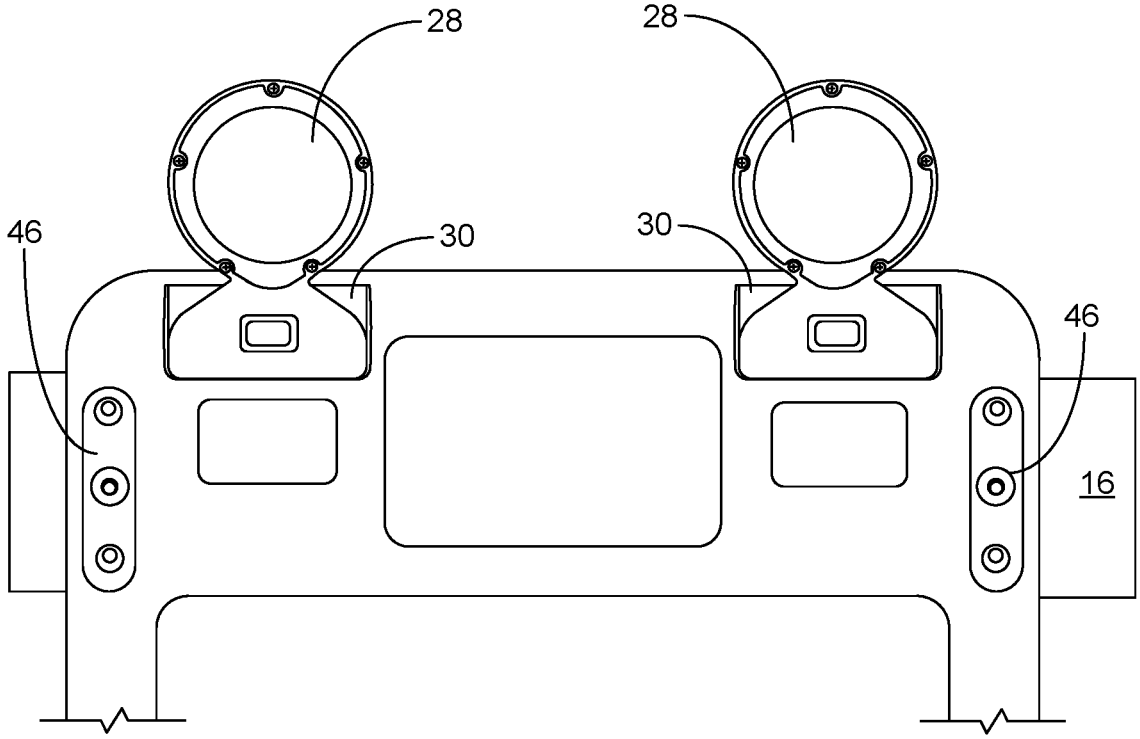
FIG. 6 illustrates an upright with the warning lights affixed thereto.

As shown in various ones of the Figs., a pair of holes 46 is disposed adjacent opposite sides each upright. The holes 46 extend from the front surface of each upright, above the recessed portion 26' thereof (FIGS. 1 and 2), to the surfaces of the warning light recesses 30 (FIG. 7). The warning light recesses are adapted to receive warning lights 28 (FIGS. 6 and 8); the warning lights are affixed to the upright via bolts 56 that, when tightened, urge the back surface of the warning light 28 against the surface 34 of the warning light recess 30. The proportions of the walls of the warning light recesses 30 are such that, when the warning light is inserted into warning light recess 30 and bolted to the upright, the bottom inside corner thereof is urged against a corresponding corner of the warning light recess 30, as shown at 58 in FIG. 8. This proportioning aids in preventing the warning light from spinning about its retaining bolt 58, and thus assists in keeping the warning light visible to oncoming motorists.

Figure 8:
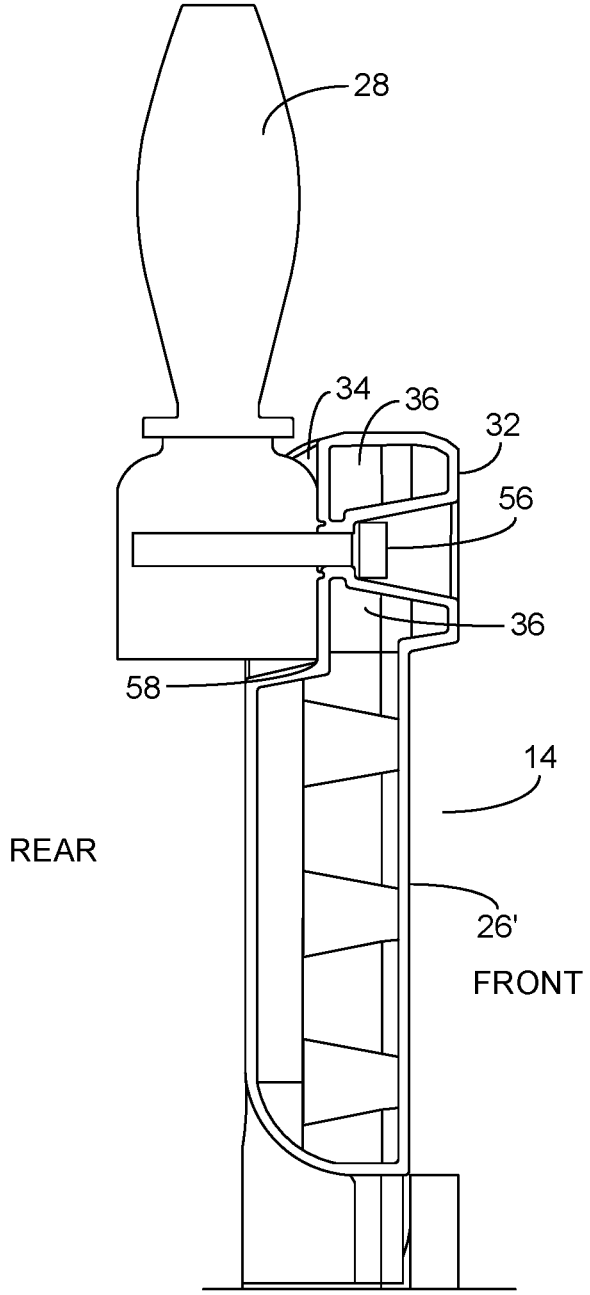
FIG. 8 illustrates details of the cushion.

As mentioned, the uprights and bases are preferably formed of a polymeric or thermoplastic material via a rotational molding process. The use of rotational molding provides several advantages such as providing increased stiffness and stability due to additional material being deposited at corners of the bases and uprights during molding, as contrasted to blow molding or injection molding. Another advantage of manufacturing the uprights via rotational molding is that it facilitates the creation of a hollow interior portion designed to provide cushioning in the event of a collision between a vehicle and a barricade. As shown in FIG. 8, during the molding process, a space or hollow portion 36 is created between wall 32 of the upright and wall 34 of the warning light recess 30 that provides the cushion. The hollow functions as a cushion since it allows the walls to deform in the event of a collision between a vehicle and the barricade and absorbs the shock of the collision. The cushion thus serves to decelerate the battery compartment of the light (the heaviest component) in the event of a collision and minimizes the force of impact upon the vehicle from the battery compartment of the warning light. This feature minimizes the chance that the battery compartment will penetrate the cabin of the vehicle and therefore addresses the greatest threat to the windshield/passenger compartment. The cushion may spring back to its original shape after the collision.

The invention claimed is:

1. A traffic barricade system comprising:

a. a substantially U-shaped thermoplastic upright, wherein the bottom of the U defines a top of the upright and the sides of the U define legs of the upright, comprising an aperture extending in a direction from a front surface to a back surface of each leg adjacent a bottom of the leg, defining leg apertures, and an opening extending into the interior of each leg from a bottommost portion thereof in a direction substantially perpendicular to the direction of the leg apertures, defining post receiving apertures;

b. a thermoplastic substantially rectangular base comprising a pair of posts extending from a top surface of the base and disposed at one end thereof and a pair of openings extending from the top surface to a bottom surface of the base at an opposite end of the base, defining base apertures;

wherein, c. each base and upright is adapted to form a shipping configuration wherein a plurality of bases and uprights may be stacked such that alternating bases in the stack are oriented in a reverse direction relative to one another and the posts are received into the base apertures of adjacent bases in the stack and the bases interlock with one another and form a cavity adapted to receive a plurality of the uprights therein;

d. each base and upright is adapted to form a transportation configuration wherein the plurality of uprights may be sandwiched between the plurality of bases to form a deck such that the posts are received into the leg recesses of adjacent uprights; and, e. each base and upright is adapted to form a deployment configuration wherein the upright may be assembled to the base such that the post receiving apertures receive the posts and the upright is substantially perpendicular to the base.

2. The system according to claim 1 further comprising a pin extending from each post, and a recess in the bottom surface of the base opposite each post defining a pair of base recesses, wherein, in the shipping configuration, the pins are received into the base recesses of alternating bases, and in the transportation configuration, the pins are received into the base recesses of a next base in the deck.

3. The system according to claim 1 further comprising a plurality of barricade panel recesses on the front surface of each leg and a barricade panel recess extending across a top surface of the upright, each barricade panel recess being adapted to receive a barricade panel and each barricade panel recess having a depth such that, when installed, a front surface of each barricade panel is recessed relative to the front surfaces of the legs and the top surface of the upright.

4. The system according to claim 1 further comprising a pair of recesses disposed in a back surface of the upright adapted to receive a warning light, defining warning light recesses, and having dimensions such that, when installed, corner portions of a housing of the warning lights contact corner portions of the warning light recesses so as to prevent the warning light from rotating about a bolt affixing the warning light to the upright.

5. The system according to claim 4 further comprising a hollow portion in the top of each upright disposed between a surface of the recess and an adjacent surface in a top portion of the upright, defining a cushion adapted to deform and at least partially absorb impact of a force resulting from a collision between the barricade and a vehicle.

6. The system according to claim 1 wherein the base and upright are formed in a rotational mold.

7. The system according to claim 3 further comprising dimples on the front surface of each barricade panel recess and cones on the back surface of the uprights opposite the dimples adapted to receive an implement for making holes for receiving barricade panel mounting bolts.

8. A traffic barricade system comprising:

a. a pair of opposing, substantially parallel legs and a connecting panel substantially perpendicularly joining the legs adjacent first ends thereof, an aperture extending in a direction from a front surface to a back surface of each leg adjacent a second opposite end of each leg, defining leg apertures, and an opening extending into the interior of each leg from a bottommost portion thereof in a direction substantially perpendicular to the direction of the leg apertures, defining post receiving apertures;

b. a thermoplastic substantially rectangular base comprising a pair of posts extending from a top surface of the base and disposed at one end thereof and a pair of openings extending from the top surface to a bottom surface of the base, defining base apertures, a pin protruding from each post, and a recess disposed in a bottom surface of each base opposite the post, defining base recesses;

wherein, c. a plurality of bases and uprights are adapted to be stacked in a first configuration such that alternating bases in the stack are oriented in a reverse direction relative to one another wherein the posts are received into the base apertures of adjacent bases in the stack and the pins are received into the base recesses of alternating bases, such that the bases interlock with one another and form a cavity in the stack adapted to receive a plurality of the uprights therein;

d. the plurality of bases and uprights are adapted to be arranged in a deck in a second configuration such that a plurality of uprights are sandwiched between a plurality of bases, the posts are received into the leg recesses of adjacent uprights and the pins are received into the base recesses of a next base in the deck; and, e. each base and each upright may be assembled such that the post receiving apertures receive the posts and each upright is substantially perpendicular to each base.

9. The system according to claim 8 wherein the first configuration defines a shipping configuration, the second configuration defines a transportation configuration, and the third configuration defines a deployment configuration.

10. The system according to claim 8 further comprising a plurality of barricade panel recesses on the front surface of each leg and a barricade panel recess extending across a top surface of the upright, each barricade panel recess being adapted to receive a barricade panel and each barricade panel recess having a depth such that, when installed, a front surface of each barricade panel is recessed relative to the front surfaces of the legs and the top surface of the upright.

11. The system according to claim 8 further comprising a pair of recesses disposed in a back surface of the upright adapted to receive a warning light, defining warning light recesses, and having dimensions such that, when installed, corner portions of a housing of the warning lights contact corner portions of the warning light recesses so as to prevent the warning light from rotating about a bolt affixing the warning light to the upright.

12. The system according to claim 11 further comprising a hollow portion in the top of each upright disposed between a surface of the recess and an adjacent surface in a top portion of the upright, defining a cushion adapted to deform and at least partially absorb a force resulting from a collision between the barricade and a vehicle.

13. The system according to claim 8 wherein the base and upright are formed in a rotational mold.

14. The system according to claim 10 further comprising dimples on the front surface of each barricade panel recess and cones on the back surface of the uprights opposite the dimples adapted to receive an implement for making holes for receiving barricade panel mounting bolts.

15. A traffic barricade system comprising:

a. a thermoplastic upright comprising a pair of opposing, substantially parallel legs and a connecting panel substantially perpendicularly joining the legs adjacent first ends of the legs so as to define a substantially U-shape, wherein the bottom of the U defines the top of the upright, an aperture through a front surface to a back surface of each leg adjacent a bottom end of each leg opposite the top end thereof and defining a pair of leg apertures, each leg having a plurality of recessed portions on the front surface thereof, and the connecting panel having a recessed portion on a front surface thereof, each recessed portion defining a barricade panel receiving recess, each barricade panel recess having a depth such that, when installed, top surfaces of barricade panels are recessed relative to frontmost surfaces of the upright, each leg having an opening in a bottom end thereof and into an interior of the leg to define a post receiving aperture, and a pair of recessed portions on a back surface of the connecting panel each adapted to receive a warning light and defining warning light recesses;

b. a thermoplastic substantially rectangular base having a width substantially equal to a width of the upright and comprising opposing side members each having a post adjacent a first end of each side member protruding from a top surface thereof, a pin protruding from a top surface of each post, a recess in a bottom surface of each base disposed opposite each post and defining a pair of base recesses, and an aperture adjacent an opposite end of each side member through the top surface to the bottom surface defining a pair of base apertures;

wherein, c. each base is adapted such that a plurality of bases may be stacked to form a first configuration wherein, when stacked, alternating bases in the stack are oriented in a reverse direction relative to each other and the posts of bases are received into the base apertures of adjacent bases in the stack and the buttons are received into the base recesses of alternating bases, such that the bases interlock with one another and form a cavity adapted to receive a plurality of uprights therein;

d. each base and each upright is adapted such that the plurality of bases and uprights may be interleaved to form a second configuration wherein the uprights are sandwiched between the bases to define a deck of bases and uprights wherein the posts are received into the leg recesses of adjacent uprights and the pins are received into the base recesses of a next base in the deck; and, e. each base and upright is adapted to be assembled to form a third configuration wherein the posts are received into the post receiving apertures and the upright is substantially perpendicularly attached to the base.

16. The system according to claim 15 further comprising a pair of panel recesses disposed in a back surface of the upright adapted to receive a warning light, defining warning light recesses, and having dimensions such that, when installed, corner portions of a housing of the warning lights contact corner portions of the warning light recesses so as to prevent the warning light from rotating about a bolt affixing the warning light to the upright.

17. The system according to claim 15 further comprising a hollow portion in the top of each upright disposed between a surface of the recess and an adjacent surface in a top portion of the upright, defining a cushion adapted to deform and at least partially absorb a force resulting from a collision between the barricade and a vehicle.

18. The system according to claim 15 wherein the base and upright are formed in a rotational mold.

19. The system according to claim 15 wherein the first configuration defines a shipping configuration, the second configuration defines a transportation configuration, and the third configuration defines a deployment configuration.

20. The system according to claim 15 further comprising dimples on the front surface of each barricade panel recess and cones on the back surface of the uprights opposite the dimples adapted to receive an implement for making holes for receiving barricade panel mounting bolts.

* * * * *